United States Patent [19]

Fraser

[11] 4,109,396

[45] Aug. 29, 1978

[54] METHOD AND APPARATUS FOR AN IMPROVED SHELF AND TRAY ASSEMBLY FOR A FREEZE DRYER

[75] Inventor: Douglas S. Fraser, New Paltz, N.Y.

[73] Assignee: FTS Systems, Inc., Stone Ridge, N.Y.

[21] Appl. No.: 747,939

[22] Filed: Dec. 6, 1976

[51] Int. Cl.[2] ..... F26B 11/18; F26B 25/18

[52] U.S. Cl. ..... 34/192; 34/92; 34/238; 34/231

[58] Field of Search ..... 34/92, 192, 197, 198, 34/200, 237, 238

[56] References Cited

U.S. PATENT DOCUMENTS

| | | | |
|---|---|---|---|
| 298,916 | 5/1884 | Travis | 34/237 |
| 794,564 | 7/1905 | Stiff | 34/192 X |
| 1,267,144 | 5/1918 | Taylor | 34/200 |
| 1,287,145 | 12/1910 | Vernon | 34/238 |
| 3,289,314 | 12/1966 | Porta | 34/197 |
| 3,488,860 | 1/1970 | Bender et al. | 34/238 |

*Primary Examiner*—John J. Camby

*Attorney, Agent, or Firm*—Robert E. Wagner; Gerald T. Shekleton; Robert E. Browne

[57] ABSTRACT

A method and apparatus for effecting an efficient heat transfer between a shelf and a tray of a freeze drying apparatus. A unique method comprising the steps of placing two halves of the shelf on a bowed jig and welding together forms a hollow shelf having a substantially flat heat transfer surface on which a tray containing materials to be freeze dried may be placed. Throughout the shelf interior circulates a heat transfer fluid. The tray and the freeze drying chamber have mating hold-down rails which bias the tray against the shelf surface to effect superior heat transfer.

10 Claims, 10 Drawing Figures

METHOD AND APPARATUS FOR AN IMPROVED SHELF AND TRAY ASSEMBLY FOR A FREEZE DRYER

BACKGROUND OF THE INVENTION

This application relates to freeze dryers and, more particularly, to a method and apparatus for the construction of a shelf and tray for use in a freeze drying chamber.

Freeze drying is generally accomplished with different types of apparatus, e.g., manifold freeze dryers and bulk freeze dryers. Manifold freeze dryers are commonly used in small scale laboratory research, whereas bulk freeze dryers are for larger volumes of material to be dried. Generally, in the bulk freeze drying, the material to be dried is poured directly into trays or into individual containers which are then placed on trays. The trays are then placed inside one large vacuum chamber, which is automatically refrigerated and to which vacuum is applied.

A fast and efficient freeze drying process requires that the material being dried be first frozen in an efficient manner. Thus, thermal conductivity between the tray and the environment in which the tray sits must necessarily be very high. To attain such high thermal conductivity, the shelf and the tray should be in intimate physical contact at as many points as possible. This may be accomplished in one manner by clamping the tray to the shelf at various points on the periphery. However, this procedure is time consuming, and the time spent in clamping the tray to the shelf might just as efficiently be spent in additional refrigeration time of the tray. Therefore, a need has arisen for a means of quickly and efficiently locking a tray containing the material to be freeze dried onto the shelf to gain as much surface contact between the shelf and the tray as possible.

Even though the tray may be clamped onto the shelf, this alone does not insure the maximum surface contact of the tray and the shelf. A tray may be made to conform to a substantially flat shelf surface when locked into place on the shelf. However, if the shelf presents an irregular or warped surface, surface contact, and thus thermal conductivity, between the shelf and the tray is reduced. Thus, a method of constructing a substantially flat shelf, while retaining the fluid-tight characteristics of the shelf for refrigeration purposes, becomes desirable.

The bulk freeze dryer generally comprises a freeze drying chamber having one or more shelves. These shelves generally have condenser coils soldered or welded to its underside to provide the cooling capacity of the freeze dryer. The condenser coils are generally welded to the shelf to provide intimate contact with the shelf for efficient thermal transfer. However, the problem arises in the welding of the condenser tubing to the shelf surface that the shelf surface itself warps, thereby losing its effectiveness as a thermal transfer surface as there is no longer the maximum surface contact at the interface of the tray with the shelf surface.

DESCRIPTION OF THE INVENTION

The subject invention overcomes these problems and disadvantages of the prior art with a shelf and tray for a freeze dryer which brings both shelf and tray into intimate contact for efficient thermal transfer between the two surfaces while providing for a quick placement and easy removal of the tray upon the shelf. The method of forming the shelf provides for a substantially flat surface on which the tray may rest. The shelf is formed of an upper and lower member, the lower member having perforations spaced in a geometric pattern about its surface. The shelf halves enclose a refrigerant circulation chamber, which provides for the circulation of a refrigerant throughout the shelf through a series of continuous paths defined by the interior chamber walls. These interior chamber walls are formed through the use of Z-shaped bars which are so arranged within the chamber to provide for the circulation of refrigerant equally to all parts of the interior chamber. These Z-shaped bars are in intimate contact with the shelf wall members for efficient thermal transfer to the exterior shelf surface. There are no "hot" spots or deviating temperature ranges on the surface of the shelf since the refrigerant is either in direct contact with the shelf sides or in indirect efficient thermal contact with the shelf through the Z-shaped bars.

The intimate contact of the Z-shaped bars with the shelf surface is effected by a method of construction which retains a flat shelf surface. The Z-shaped bars are first spot welded to the underside of the upper shelf member in a predetermined pattern. The lower shelf member is perforated to correspond to this predetermined pattern so that the perforations appear over each Z-shaped bar. When the shelf members are placed together, the mated members are then placed on a jig and clamped to force the two shelf members to a bowed or partial spherical shape. While so clamped, the Z-shaped bars are plug welded through the perforations to the lower shelf member and the two shelf members are then welded together around the edges. The clamps are released and the shelf returns to an unstressed posture, which is substantially flat. Since there is no substantial welding to cause the upper shelf member to warp, and also since the bowed contour of the shelf during welding relieves any stress normally observed after welding which might contort the shelf surface, a substantially flat heat transfer is made possible with a minimum of expense and labor.

The trays, which may either contain the material to be dried or merely form a platform on which to support beakers, ampules, etc. which contain the material to be freeze dried, are made to rest on top of the shelves in a locked position, which forces the tray to come into intimate contact with the top surface of the shelf. Within the freeze drying chamber and above each shelf, hold-down rails or flanges are secured on the chamber walls. These chamber hold-down rails have one side tapered, decreasing in width as it approaches the front of the chamber. Similar hold-down rails are on the tray sides, though when inserted into the chamber the taper is to the rear. Thus, the hold-down rail on the chamber walls will point toward the front entrance of the chamber, while the hold-down rail on the tray will point toward the rear of the chamber when locked onto the shelf. By the use of such hold-down rails, the whole tray may be inserted into the chamber and guided onto the shelf by the rails and quickly locked into position for an intimate contact with the shelf surface, and just as easily detached from the locking position and removed from the chamber. There is no difficulty in securing, latching, mating threads or the like in either inserting or removing the tray. The procedure is simple and allows for no lost time in its use.

It is, therefore, an object of the subject invention to provide a new and useful apparatus for efficient thermal transfer between a shelf and a tray for a freeze drying chamber.

Another object of the subject invention is a method of constructing a shelf for a freeze drying apparatus to provide a substantially flat shelf surface.

A further object of the subject invention is to provide a means for easily locking a tray into intimate contact with a shelf of a freeze drying chamber while allowing for the easy removal of the same.

A still further object of the subject invention is a shelf for use in a freeze drying chamber which allows intimate contact of a refrigerant fluid with a shelf surface.

Another object of the subject invention is to provide an apparatus and method capable of obtaining the above-designated objectives which are simple, economical and effective.

These objects and other features and advantages of the subject invention will become readily apparent upon reference to the following description when taken in conjunction with the accompanying drawings, wherein.

Figure 1:
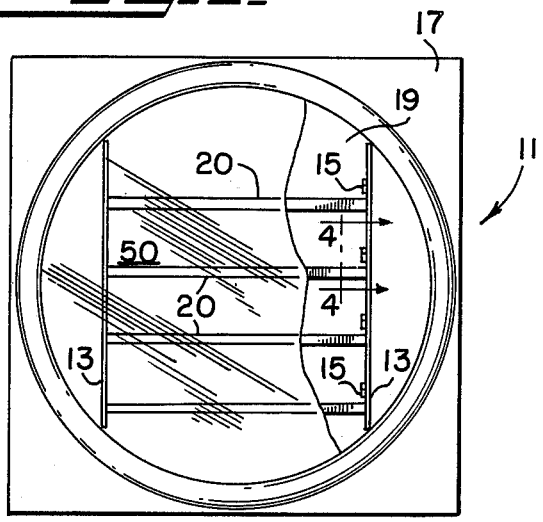
FIG. 1 is a plan view of a freeze drying chamber of the subject invention.

Referring now to FIG. 1, there is shown a freeze dryer 11 having a removable front or door 17. This front 17 generally has a translucent section 19 formed of plexiglass or the like through which the interior of the freeze drying chamber 50 may be viewed. The freeze drying chamber 50 comprises a plurality of shelves 20 mounted between shelf supports 13.

Figure 3:
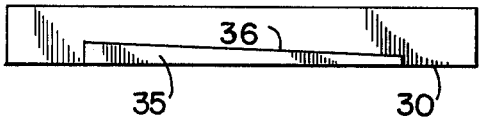
FIG. 3 shows a cross section taken along line 3–3 of FIG. 2 showing the hold-down rails of the tray.
Figure 4:
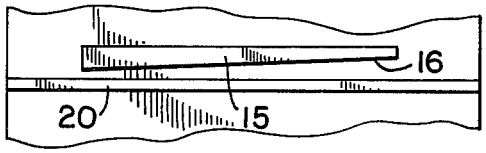
FIG. 4 is a cross section taken along line 4—4 of FIG. 1 showing the hold-down rails of the freeze drying chamber.

Chamber hold-down rails 15, as shown in FIG. 4, are elongated, with the lower edge or surface 16 tapering or sloping up toward the chamber front. Each tray 30 has a corresponding or mating hold-down rail or flange 35 on two opposing sides of the tray (FIG. 3). The tray rails 35 are of the same overall elongated shape as the chamber rails and have substantially the same degree of taper, however, the upper edge 36 of the tray rail 35 tapers or slopes downwardly and to the rear 39 of the tray 30. The tray rails 35 initially guide the tray 30 by a loose engagement with the respective opposing chamber rails when the tray is inserted into the chamber 50 on one of the shelves 20. Sliding the tray 30 further in on the shelf 20 causes the opposing rails to mate and secure or bias the tray intimately against the shelf 20. The opposing rails serve to guide the tray 30 to a proper placement on the shelf 20, though not fully engaging each other until the tray is in proper position.

As a result of the initially incomplete engagement of the rails 15 and 35, the tray 30 may be easily inserted into the chamber 50 and then biased and locked into tight and intimate engagement with the shelf 20 without time-consuming manipulations or adjustments. Upon the completion of the freeze drying procedure, the tray 30 is easily removed from the shelf 20 in a reverse manner by simply withdrawing the tray 30. Even though the tray 30 is securely locked against the shelf 20, the removal is accomplished with facility, being easily slid off the shelf 20. There is no extraneous hardware which must be released or removed. The procedure is extraordinarily simple: Push in for insertion and pull out for removal. It should also be recognized that the tapered rails or flanges could be placed on the door and on the back of the chamber. In this embodiment, the tray would be inserted onto the shelf and the opposing rails of the tray and chamber engaged. Upon closing the door of the chamber, the rail on the door would engage and bias the tray against the shelf surface to effect the desired surface contact.

Figure 2:
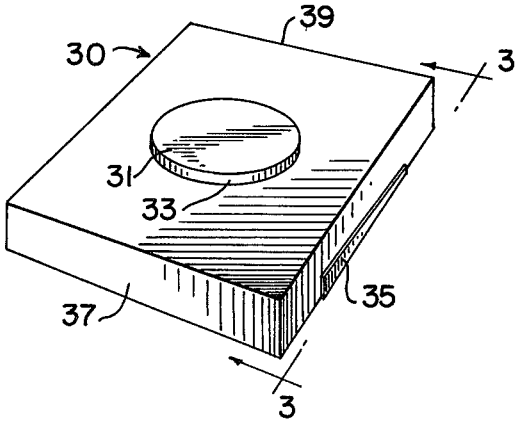
FIG. 2 is a plan view of a tray for use in the freeze drying apparatus of the subject invention.

The tray of the subject invention may be either a simple tray for carrying ampules, vials or the like, or it may be one for bulk freeze drying in which a large quantity of material to be freeze dried is poured into a tray 30, as shown in FIG. 2, through a large aperture or orifice having an upstanding flange about its periphery. The orifice is covered with a filter 31 of paper or cloth, which may be held in place by a band 33 about the flange. In this way, the vapors may escape through the filter 31 while retaining the powdered material being dried within.

The shelves of the subject invention employ a unique method of manufacture, enabling them to obtain a very efficient heat transfer surface for the above-described trays. Rather than rely upon the imperfect and inefficient contact of condenser tubing welded or soldered to the top of the shelf, as is generally found in the prior art, the subject invention rapidly circulates heat transfer fluid throughout the hollow interior of the shelf 20 to provide both a product freezing capability and a uniform source of controlled heat for the sublimation of water vapor from heat-sensitive samples. Channels 24 are formed within the shelf, providing for the rapid circulation of the heat transfer fluid throughout the interior of the shelf 20 to allow all parts of the shelf to be cooled or heated, as desired (FIG. 5).

Figure 5:
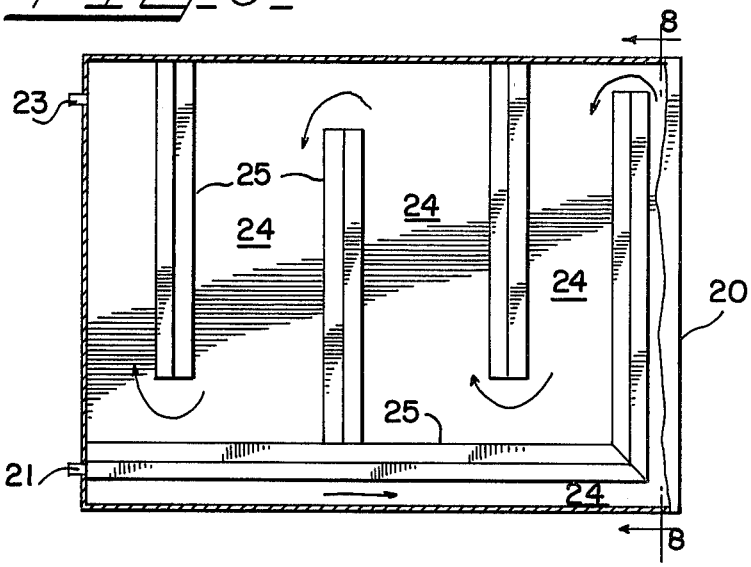
FIG. 5 is a top view of the lower shelf member showing the placement of the Z-shaped bars.
Figure 6:
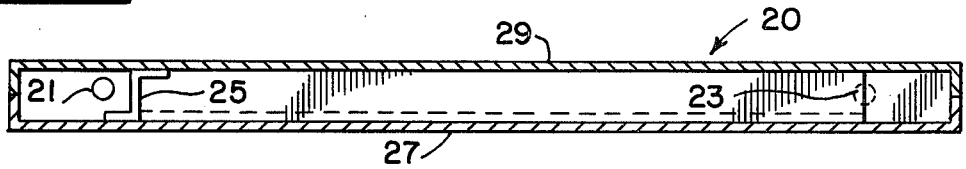
FIG. 6 is a cross section taken along line 6–6 of FIG. 5.

The channels are formed by Z-shaped bars 25 (Z-bars) (FIGS. 5 and 6). These Z-bars 25 direct the flow of the heat transfer fluid to substantially all portions of the interior of the shelf. The heat transfer fluid is circulated through a compressor pump (not shown), being introduced into the shelf 20 at inlet 21. The shelf 20 is a hollow, fluid-tight chamber having a substantially flat top surface 29 and a bottom portion 27, with Z-bars disposed between the upper and lower portions forming both a structural support for the upper shelf portion and simultaneously forming channels 24 for the passage of heat transfer fluid. The heat transfer fluid circulates in the channels 24 in the direction generally indicated by the arrows in FIG. 5 and is exhausted at outlet 23 to return to the compressor pump or to circulate through another shelf chamber, as desired.

Figure 7:
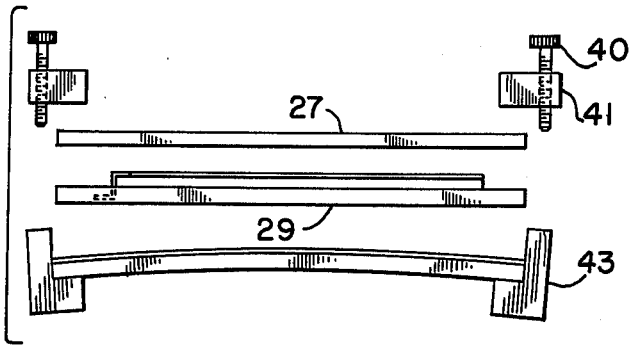
FIG. 7 is an exploded view of a clamped shelf prior to being spot welded, showing the curvature of the jig.
Figure 9:
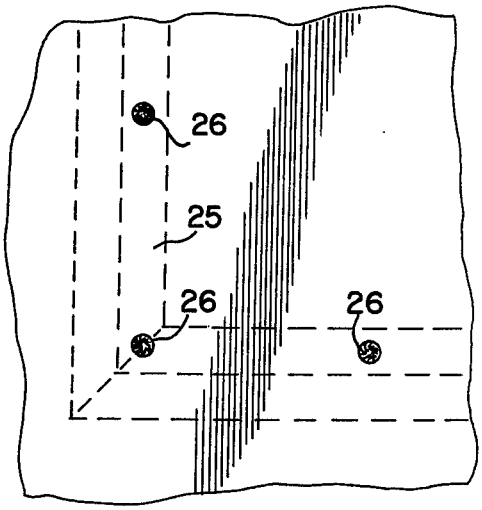
FIG. 9 is a partial cut-away view of a shelf showing the Z-shaped bars in relief and the spot welding of the Z-shaped bars at the perforations.
Figure 8:
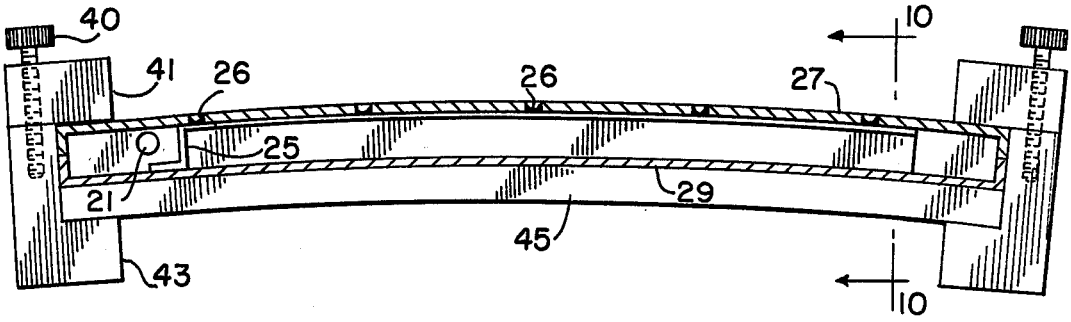
FIG. 8 is a cross-sectional side view showing the clamped shelf prior to spot welding and the curvature of the shelf in one plane when conforming with the curvature of the jig.
Figure 10:
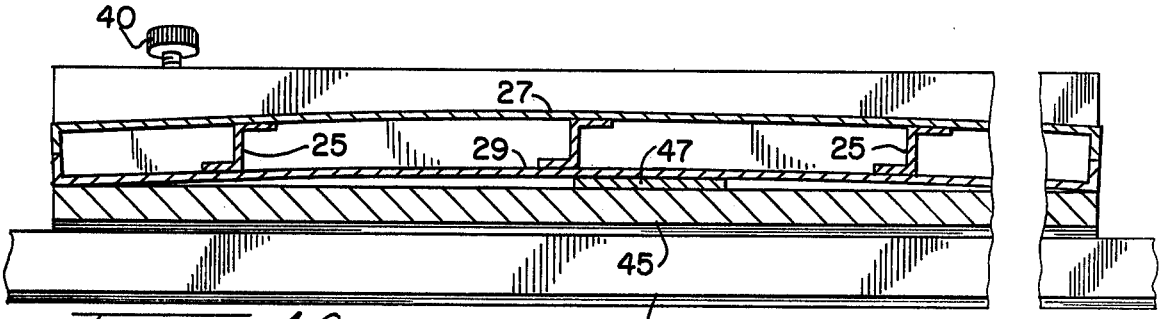
FIG. 10 is a cross-sectional view taken along line 10—10 of FIG. 8 showing the spacer bar of the jig for retaining the curvature of the shelf in a plane different from that shown in FIG. 8.

To achieve the substantially flat top surface 29 in the inventive method of the subject invention, the Z-bars are first spot welded onto the underside of the top shelf portion 29 in the appropriate position, as suggested by FIG. 5. Perforations are formed in the lower shalf portion 27 to correspond with the placement of the Z-bars 25 so that when the upper shelf portion 29 and the lower shelf portion 27 are joined, the Z-bars may be seen through the perforations 26 of the lower shelf portion 27 (FIG. 9). The lower shelf portion 27 is then clamped in place over the upper shelf portion 29 on a jig or fixture which holds and clamps the assembled shelf into a bowed or partially spherical shape, that is, each lateral edge of both shelf portions 27 and 29 are forced into an arcuate shape, causing the entire shelf to acquire a slightly convex shape. FIGS. 8 and 10 illustrate this arrangement, whereby the jig 45 has an arcuate surface to force a curvature in the shelf along one plane, while a spacer strip 47 of about 0.030 inch in thickness is placed intermediate to the shelf ends and parallel with the plane of curvature of the jig 45. The shelf is placed on the jig and clamped in place with a suitable clamp, such as that shown in FIGS. 7 and 8. The clamp itself includes a top clamp portion 41 affixed to a lower clamp portion 43; the two clamp portions are brought together and tightened wtih a screw 40 or other fastening means, thereby exerting a positive force to conform the shelf to the shape of the jig and thereby assume a corresponding partially spherical shape.

While so clamped, the perforations 26 are plug welded to the Z-bars 25 (FIGS. 8 and 9) and the interface between upper shelf member 29 and lower shelf member 27 is also welded to retain the upper and lower shelf portions together as a unitary shelf with a fluid-tight closure in which the heat transfer fluid may circulate.

Upon completion of the welding, the clamps 41 and 43 are released and the shelf 20 reverts to a substantially flat top surface 29. The shelf may now be clamped into place within the freeze drying chamber and is ready for use.

The substantial contact of the top surface 27 with the heat transfer fluids circulating within the shelf channels 24 permits a very uniform cooling or heating effect of the shelf surface 27, enabling a user to freeze dry more material than heretofore possible. Further, the substantially flat surface gained by the use of the method of the subject invention enables a still more efficient transfer of thermal energy to a tray placed on the top of the shelf 20 of the subject invention. As already stated, the ability of the hold-down rails 35 and 15 to lock a tray 30 into intimate contact with the shelf 20 provides for that efficient thermal energy transfer. This intimate contact is made possible by the substantially flat surface of the tray 20.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of this invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. In a freeze drying chamber, at least one shelf and tray assembly comprising a shelf having a substantially flat upper surface, said shelf being hollow and allowing for the rapid circulation of a heat transfer fluid within, a tray for containing material to be freeze dried, said tray having tapered hold-down rails on opposing sides, said chamber having elongated tapered hold-down rails on opposite sides above said shelf, said hold-down rails of said tray tapering in an opposite direction from said hold-down rails of said chamber, said hold-down rails of said shelf mating and locking with said hold-down rails of said tray when said tray is inserted onto said substantially flat upper surface of said shelf, thereby bringing said tray into intimate contact with said upper surface of said shelf and increasing the transfer of thermal energy between said shelf and tray.

2. The shelf and tray assembly of claim 1 wherein said shelf has a hollow interior for the circulation of heat transfer fluid, said heat transfer fluid circulating in channels within said shelf, said channels being defined by Z-shaped bars.

3. The shelf and tray assembly of claim 1 wherein the elongated hold-down rails of said tray are tapered to a rear end of said tray, said degree of taper being substantially identical to the degree of taper of said shelf hold-down rails.

4. The shelf and tray assembly of claim 1 wherein said hold-down rails of said shelf taper to the front of the chamber.

5. The shelf and tray assembly of claim 1 wherein said tray is for the bulk freeze drying of materials, said tray being hollow for retaining said bulk materials to be freeze dried within said tray, said tray having an aperture for the filling of said materials into such tray and for the escape of vapors from said materials when being dried, said aperture having an upstanding flange about its periphery, said flange being integral with the top surface of said tray, said aperture being covered by a filter, said filter being held in place over said aperture by a band retaining said filter over said upstanding flange and on said tray.

6. In a freeze drying apparatus including a chamber, a shelf mounted in said chamber for the support of a tray containing materials to be dehydrated, said shelf having a heat transfer surface for transferring heat to and from a heat transfer fluid, said heat transfer fluid circulating adjacent said heat transfer surface, said tray having outwardly extending peripheral flanges on opposing sides, said chamber having inwardly extending opposing side flanges, said chamber flanges sloping in one vertical direction, said tray flanges sloping in an opposite vertical direction, said degree of slope of said tray flange and said chamber flange being substantially identical, and said tray flange and said chamber flange adapted to mate and bias said tray against said heat transfer surface of said shelf for a more efficient transfer of heat between said tray and said shelf.

7. The freeze drying apparatus of claim 6 wherein said chamber has a door and said chamber flanges are above a shelf on opposing chamber sides adjacent said door.

8. The freeze drying apparatus of claim 7 wherein said chamber flanges slope upwardly toward said door and said tray flanges, when in position to mate with said chamber flanges, slope downwardly away from said door.

9. In a freeze drying apparatus, a shelf, said shelf being capable of supporting an associated tray and having an upper heat transfer surface and a lower heat transfer surface, said upper and lower heat transfer surfaces being joined to form an inner chamber, said upper heat transfer surface having a substantially planar exterior, said chamber having paths for the circulation of a heat transfer fluid within, said paths being formed with interior shelf supports, said interior shelf supports being in contact with said heat transfer surfaces and being thermally conductive to cooperate with said circulating heat transfer fluid to uniformly maintain the temperature of said upper and lower heat transfer surfaces within a specified range, and said substantially planar exterior of said upper heat transfer surface capable of being in maximum physical contact with a lower surface of said associated tray for maximum heat transfer between said tray and said shelf.

10. The freeze drying apparatus of claim 9 wherein said interior shelf supports are Z-shaped bars.

* * * * *